United States Patent [19]

Fender

[11] Patent Number: 4,770,964

[45] Date of Patent: Sep. 13, 1988

[54] MAGNETIC IMAGING MEMBER AND FABRICATION PROCESS THEREFOR

[75] Inventor: William D. Fender, Pasadena, Calif.

[73] Assignee: Xerox Corporation, Stamford, Conn.

[21] Appl. No.: 946,220

[22] Filed: Dec. 23, 1986

[51] Int. Cl.[4] ..... G03G 5/14

[52] U.S. Cl. ..... 430/65; 430/66; 430/86

[58] Field of Search ..... 430/58, 62, 63, 64, 430/65, 69, 85

[56] References Cited

U.S. PATENT DOCUMENTS

| | | | |
|---|---|---|---|
| 3,615,405 | 10/1971 | Shebanow | 430/65 |
| 3,973,960 | 11/1976 | Dulken et al. . | |
| 4,008,082 | 2/1977 | Beschoner et al. . | |
| 4,011,079 | 3/1977 | Berle et al. . | |
| 4,098,655 | 7/1978 | Ward et al. . | |
| 4,126,457 | 11/1978 | Ciuffini . | |
| 4,277,551 | 7/1981 | Sonnonstine et al. . | |
| 4,298,671 | 11/1981 | Kassel et al. . | |

FOREIGN PATENT DOCUMENTS

| | | |
|---|---|---|
| 0151843 | 11/1979 | Japan . |
| 0009502 | 1/1980 | Japan . |
| 0068848 | 4/1982 | Japan . |
| 0171960 | 9/1984 | Japan . |

OTHER PUBLICATIONS

W. D. Fender, "Quantification of the Xeroradiographic Discharge Curve", SPIE, vol. 70 (1975), 364.

L. S. Jerome et al., "Process Studies on Higher Sensitivity Xeromammograhy", SPIE, vol. 555.

R. C. Speiser et al., "Dose Comparisons for Mammographic Systems", Med. Phys., 13(5), Sep./Oct. 1986, 667.

*Primary Examiner*—John L. Goodrow

*Attorney, Agent, or Firm*—Peter H. Kondo

[57] ABSTRACT

A planar electrophotographic imaging member comprising a magnetically attractable, electrically conductive layer, a thin aluminum layer, an aluminum oxide blocking layer and at least one x-ray photoconductive selenium alloy insulating layer. This planar electrophotographic imaging member may be fabricated by providing a planar substrate comprising a magnetically attractible, electrically conductive layer and a thin aluminum layer bearing an aluminum oxide blocking layer, mounting the substrate on a magnetic support member, the blocking layer facing away from the magnetic support member, and applying at least one x-ray photoconductive insulating layer to the blocking layer. The planar electrophotographic imaging member may be overcoated while the substrate remains mounted on the magnetic support member.

11 Claims, No Drawings

MAGNETIC IMAGING MEMBER AND FABRICATION PROCESS THEREFOR

BACKGROUND OF THE INVENTION

The present invention relates in general to electrophotographic imaging members and processes for fabricating the members.

A common technique for manufacturing xeroradiographic photoreceptor plates involves vacuum deposition of an amorphous selenium alloy layer having a thickness of about 150 microns onto an aluminum substrate at about 75° C. (167° F.). The deposited selenium alloy layer is usually free of crystalline selenium. These xeroradiographic plates may be overcoated with a protective coating.

Small x-ray selenium photoreceptor plates normally comprise an aluminum substrate. The aluminum substrate is desirable to achieve a selenium-substrate interface which will yield a low dark decay rate and minimal defect level. The aluminum substrate is usually mounted with double backed adhesive tape onto a support member in a vacuum coater.

For dental plates, a large number of plates, usually 216 plates, are vacuum coated at one time. A double sided adhesive tape is manually applied to the back of each of the 216 plates. Each of these taped plates is thereafter applied onto a support member. The support member bearing the 216 plates is inserted into a vacuum chamber for deposition of selenium onto the exposed surface of each substrate. Prior to deposition of the selenium onto the substrate, a vacuum is imposed on the vacuum chamber to out gas undesirable gasses and vapor contained in the adhesive tape. The 216 plates are thereafter removed from the vacuum coater and an overcoating of protective material is applied to each plate. The tape is thereafter removed from each of the 216 plates and each plate is cleaned to remove any residual adhesive. Each of the 216 plates are thereafter individually glued to separate plastic bases and individually tested for defects. Any defects found during testing requires discarding of the plate and plastic base. Acceptable plates in the plastic bases are subsequently inserted into light tight packages for insertion into a patient's mouth during x-ray exposure.

This dental plate fabrication process is laborious and extremely time consuming. It is apparent that considerable coating equipment down time occurs due to cleaning the plate holders, applying 216 pieces of double sided sticky tape, mounting 216 plates on the tape pieces, outgassing the tape, vacuum coating the plates, removing the plates and repeating the process steps for applying a protective overcoating to each plate. Moreover, the cost of the plastic base and the time spent for gluing are lost for those plates are rejected after testing. Moreover, the discarding of defective plates includes loss of the plastic bases and time to glue the plates to the plastic bases.

PRIOR ART STATEMENT

Japanese Patent Publication No. JA 0171960, September 1984 An electrophotographic photoreceptor is disclosed comprising a conductive base and a photoconductive layer. The conductive base can be made of aluminum, chromium, nickel plate or a metalized polyester film and the photoconductive layer contains an organic aluminum coupling agent. This is a non selenium photoreceptor patent that is unrelated to x-ray imaging.

W. D. Fender, *Quantification of the Xeroradiographic discharge curve,* SPIE Vo. 70 (1975) 364—Amorphous selenium alloy photoreceptors are disclosed having a thickness of 120 to 300 micrometers. These photoreceptors were doped with both arsenic and chlorine.

L. S. Jerome et al, *Process Studies On Higher Sensitivity Xeromammography,* SPIE Vo. 555 Medical Imaging and Instrumentation '85 (1985) 127—Xeroradiographic photoreceptor are disclosed.

R. C. Speiser et al, *Dose Comparisons For Mammographic Systems,* Med. Phys. 13(5), Sep/Oct 1986 667—A selenium xeroradiographic photoreceptor is disclosed.

Japanese Patent Publication No. JA 0009502, January, 1980—An electrophotographic material base plate is disclosed comprising a transparent resin film, a thin metal oxide layer, and thin layer of aluminum. The base plate is transparent to light not to x-rays and therefore would not be suitable for x-ray photoreceptors.

Japanese Patent Publication No. JA 0068848, April, 1982—An electrophotographic photoreceptor is disclosed comprising a conductive support having a metallic surface, a modified ether type polyester intermediate layer, and a photoconductive layer. The conductive support consists of a metal plate, paper or plastic film which is coated with a metal foil. This patent describes a multi-layered organic metallic substrate which is not suitable for vacuum deposition of amorphous selenium and continuous gray scale imaging.

Japanese Patent Publication No. JA 0151843, November, 1979—A conductive base for electrophotographic light sensitive material is disclosed comprising a thin layer of stannic oxide on the surface of aluminum plate or foil (including aluminum layer on synthetic resin film or stainless steel by vacuum evaporation, etc.). This device is designed for optical rather than x-ray imaging applications.

In U.S. Pat. No. 4,298,671 to Kassel et al an electrophotographic recording material is disclosed comprising a layer of amorphous selenium and a layer of crystalline selenium. The device consists of an electrically conductive substrate, upon which is vapor-deposited a thin layer of tellurium. A layer of crystalline selenium is deposited on the tellurium layer and then a layer of amorphous selenium is deposited on the crystalline selenium layer. In a specific example, selenium is deposited at a rate of 1 micrometer/min until a thickness of 60 micrometers is attained. The previously deposited tellurium causes a 0.3 to 3 micrometer layer of crystallized selenium to form. Various crystallization techniques are described in the background of the invention. The photoreceptor of Kassel et al requires multiple layers of photoconductive material and is designed for monopolar carrier transport. Moreover, this patent does not provide the bipolar transport needed for x-ray imaging.

In U.S. Pat. No. 4,098,655 to Ward et al a method is disclosed for fabricating a photoreceptor wherein the photoreceptor substrate initially has a thin electrically insulating oxide layer on its surface. A selenious acid is applied to the oxide layer, thereby dissolving the oxide layer and forming a thin selenium layer. Depending on the chemical process and temperature involved, this thin selenium layer may be amorphous, trigonal (or crystalline) or a mixture of the two forms. A typically 10 to 60 micrometer thick photoconductive insulating layer of selenium alloy may be vacuum-deposited onto the thin selenium layer or a charge carrier transport layer may be deposited onto the thin selenium layer. The photoreceptor of Ward et al uses a cumbersome wet chemical process for forming a crystalline layer and therefore is not compatible with mass production requirements.

In U.S. Pat. No. 3,973,960 to Dulken et al an electrophotographic element is disclosed comprising an arsenic-selenium alloy containing a concentration gradient of arsenic. The concentration gradient decreases from the exposed surface of the selenium layer. The total arsenic content of the layer ranges from 1 to 20 percent, with the arsenic concentration at the free surface being at least 13 percent. The layer may also contain from 1 to 10,000 ppm halogen. In one working example, the alloy deposition process was about 50 minutes long with the crucible temperature being increased from 260° C. to 290° C. while the drum temperature was about 85° C. to form a layer of about 50 micrometers. In another working example, the alloy deposition process was about 50 minutes long with the crucible temperature being increased from 325° C. to 360° C. while the drum temperature was about 170° C. to form a layer of about 50 micrometers. The photoreceptor of Dulken et al can contain high levels of arsenic which can cause reticulation, a wrinkling of the top surface of the photoreceptor.

In U.S. Pat. No. 4,126,457 to Ciuffini a method for producing a flexible photoreceptor is disclosed wherein the photoreceptor comprises a selenium alloy layer containing a concentration gradient of arsenic. The concentration gradient is produced by evaporating and condensing selenium alloys onto a flexible substrate in a profile of increasing arsenic concentration while maintaining the temperature of the substrate or interface-substrate at no less than the glass transition temperature of the selenium alloy of lowest arsenic concentration and not less than about 85° C. The alloy may also contain 0 to 10,000 ppm halogen. In one working example, three different alloys were sequentially heated for 21 minutes each at progressively higher temperatures of 300° C., 380° C. and 420° C. while the substrate temperature was maintained at 85° C. In another working example, the alloy was evaporated at 420° C. for 60 minutes. It appears that the thickness of the alloy layers deposited in the working examples was about 60 micrometers. The photoreceptor of Ciuffini, like Dulken et al, can contain high levels of arsenic which can cause reticulation.

In U.S. Pat. No. 4,008,082 to Beschoner et al a method for producing an electrophotographic recording material is disclosed wherein a thin layer of an arsenic-selenium alloy is vapor-deposited while the substrate is held at a temperature above the glass transformation temperature of the alloy. The remaining desired thickness of the alloy is then vapor-deposited onto the first layer at a substantially lower substrate temperature. The transformation temperature is defined as that temperature at which glass has a viscosity of $10^{13.4}$ poises. For example, the first deposited layer can have a thickness of about 0.1 to 2.0 micrometers and the thickness of the second layer is variable within a broad range. Specific examples describe first layer thicknesses of about 1 micrometer and second layer thicknesses of 10 or 9 micrometers. The rate at which the substrate temperature is reduced after the deposition of the first partial layer is about half an hour. The process of Beschoner et al uses a high substrate deposition temperature of 125° C.

In U.S. Pat. No. 4,277,551 to Sonnonstine et al an electrophotographic element is disclosed comprising a substrate, a photoconductive-insulative layer and an organic electron transport overlayer. The photoconductive-insulative layer comprises a selenium-arsenic alloy containing 90 to 97.5 atomic percent selenium and can have a thickness in the range of 40 to 100 micrometers. The organic electron transport overlayer is employed to prevent crystallization of the photoconductive-insulative layer. Like Kassel et al described above, Sonnonstine et al requires multiple layers of photoconductive material and is designed for monopolar carrier transport.

In U.S. Pat. No. 4,011,079 to Berle et al a method is disclosed for producing an electrophotographic recording material by vapor-deposition of selenium or selenium alloy onto a carrier at a temperature below the glass transformation temperature and then heating the vapor-deposited layer to a temperature between the glass transformation temperature and a temperature just below that at which the electrophotographic properties change. The temperatures are selected so crystallization is not allowed to occur.

Generally, prior xeroradiographic photoreceptors exhibit deficiencies such as low resolution at low x-ray sensitivity, absence of provisions for blotch or fatigue elimination. Many photoreceptors are intended to perform in line copiers and are characterized by features that are unsuitable for high sensitivity x-ray systems. Thus, for example, some photoreceptors cannot produce a grey scale from 0 volts to full charge through frequent thermal relaxation and imaging cycles or provide resolution comparable to x-ray photographic films. Other photoreceptors exhibit low reticulation during cycling and are characterized by powder deficient spots in images produced.

Conventional line copy photoreceptors have poor x-ray sensitivity and are unsuitable for xeroradiography.

Thus, there is a need for an improved xeroradiographic imaging member and process for preparing the member.

SUMMARY OF THE INVENTION

Accordingly, it is an object of the present invention to provide an improved electrophotographic imaging member and process for preparing the imaging member which overcomes the problems encountered with electrophotographic imaging members of the prior art.

It is a further object of the present invention to provide an improved electrophotographic imaging member which provides a high purity aluminum surface for the formation of a defect free aluminum oxide blocking layer.

It is a further object of the present invention to provide an improved electrophotographic imaging member which can be magnetically attracted to magnetic supports or to electromagnets.

It is a further object of the present invention to provide an improved electrophotographic imaging member which allows the use of high purity aluminum to provide an aluminum oxide interface capable of minimizing print defect levels.

It is a further object of the present invention to provide an improved electrophotographic imaging member which improves selenium adhesion to the metal substrate by virtue of the higher purity aluminum and resultant superior $Al_2O_3$ blocking layer.

It is a further object of the present invention to provide an improved electrophotographic imaging member which is less costly to manufacture due to the elimination of the presently used adhesive backing tape.

It is a further object of the present invention to provide an improved electrophotographic imaging member which exhibits fewer artifacts which result from handling when applying and removing the presently used adhesive tape.

It is a further object of the present invention to provide an improved electrophotographic imaging member which by magnetically mounting directly to the coater support obviates the need for costly and cumbersome masks while at the same time provides edge coating.

It is a further object of the present invention to provide an improved simpler process for fabricating an electrophotographic imaging member.

It is a further object of the present invention to provide an improved process for fabricating an electrophotographic imaging member that experiences less material waste.

It is a further object of the present invention to provide an improved, more rapid process for fabricating an electrophotographic imaging member.

The above objects and others are accomplished in accordance with the present invention by providing a planar electrophotographic imaging member comprising a magnetically attractable, electrically conductive layer, a thin aluminum layer, an aluminum oxide blocking layer and at least one x-ray photoconductive selenium alloy insulating layer. This planar electrophotographic imaging member may be fabricated by providing a planar substrate comprising a magnetically attractible, electrically conductive layer and a thin aluminum layer bearing an aluminum oxide blocking layer, mounting the substrate on a magnetic support member, the blocking layer facing away from the magnetic support member, and applying at least one x-ray photoconductive insulating layer to the blocking layer. The planar electrophotographic imaging member may be overcoated while the substrate remains mounted on the magnetic support member. Moreover, the photoconductive insulating layer may comprise an alloy of selenium and arsenic having a thickness between about 100 micrometers and about 400 micrometers.

Any suitable magnetically attractible, electrically conductive substrate having a planar shape and high purity aluminum surface may be employed in the electrophotographic imaging member of this invention. The substrate material may be opaque or substantially transparent and may comprise numerous suitable materials having the required mechanical and magnetic properties and electrical conductivity. The expression "planar shape" is defined as a member having two major surfaces, wherein a straight line joining two points in one of the surfaces lies wholly in that surface. The expression "magnetically attractible" is defined as a material that exhibits a positive magnetic susceptibility such as nickel, iron and iron alloys such as steel. The expression "electrically conductive" is defined as a material that exhibits an electrical resistivity of less than about 10,000 ohm-cm. Typical magnetically attractible, electrically conductive materials include, for example, nickel, iron, steel, iron nickel and steel composites and the like. The magnetically attractible, electrically conductive layer may vary in thickness over substantially wide ranges depending on the desired use of the electrophotoconductive member. However, the thickness should not be so great that the substrate cannot be held by magnetic attraction to a support member. Accordingly, the conductive layer may generally range in thickness from about 100 micrometers to a centimeter. A typical overall dimension for a dental plate is 4 cm×3 cm×.5 cm.

The outer surface of the supporting substrate adjacent to the photoconductive selenium layer preferably comprises an aluminum oxide layer on a contiguous underlying aluminum layer. The underlying aluminum layer may be formed on the magnetically attractible, electrically conductive layer by any suitable conventional technique. For example, an aluminum layer may be applied to the substrate by sputtering in an inert atmosphere, vacuum deposited, laminated, clad, electrolytically deposited, and the like to form a securely attached aluminum layer contiguous to and in electrical contact with the magnetically attractible, electrically conductive layer. The applied aluminum layer may thereafter be oxidized by any suitable technique such as exposure to air, a standard glow discharge cycle under vacuum or formed through radiant heating under partial vacuum or in an oxygen atmosphere, and the like. The aluminum layer may have a thickness up to about 1000 micrometers and the insulating layer of aluminum oxide preferably has a thickness of between about 50 Angstroms and about 500 Angstroms because too thin a layer will not prevent electron tunneling while too thick a layer tends to "burn" through forming pinhole defect sites. Formation in a vacuum coater of an aluminum oxide layer on a previously formed aluminum metal layer can be closely monitored and controlled, for example, by regulation of the coater bleed gas flow rate with a precision flow gauge and valve. Pressure should be maintained between 10 and 100 microns of mercury. Substrate temperature should not exceed 116° C. (240° F.) and flow rate should be sufficient to maintain a high oxygen content atmosphere (about 21% for air).

Any suitable cleaning material capable of providing a defect-free photoreceptor interface may be employed. Typical substrate cleaning compositions include Oakite NSS (available from Oakite Products, Inc., New Jersey), caustic solution containing $Na_2CO3$ and $Na_3PO_4$, dip and hot deionized $H_2O$ rinse.

Any suitable magnetic or electromagnetic support member may be employed to support the planar substrates, during deposition of the x-ray photoconductive selenium alloy insulating layer, application of the protective overcoating, and testing. The magnetic support member may, for example, comprise a frame or a planet support member adapted to slide into and out of a vacuum coater. A typical vacuum coater planet holds 72 dental substrates for vacuum coating and consists of a concave disk approximately 41 cm (16 inches) in diameter. Fastened to the planet support member are magnets or electromagnets of any suitable shape or size. Fastening of the magnets to the frame may be accomplished by any suitable means such as adhesives, screws, clips, brazing, arc welding, TIG welding and the like. The strength of the magnets or electromagnets should be sufficient to retain the planar substrates to the support member during processing of the planar substrates. Supplemental aids such as lips projecting from the support member to support the lower edge of each planar substrate may be employed to reduce the magnetic strength requirements necessary to retain the planar substrates to the frame during processing. The planar substrates are mounted to the magnetic support member with the blocking layer facing away from the magnetic support member. Mounting may be carried out by any suitable means such as by hand, robots, and the like. Because the planar substrates may remain mounted to the magnetic support member during deposition of the photoconductive selenium insulating layer, during application of the protective overcoating, during drying or curing of the protective overcoating and during testing, the likelihood of deposition of fingerprints on or marring of the substrate, photoconductive insulating layer or overcoating layer are markedly reduced. Moreover, the prior art steps of manually applying pieces of 216 double sided adhesive tape to the back of 216 photoreceptors, out gassing undersirable gasses and vapor contained in the adhesive tape, removing the 216 pieces of double sided adhesive tape from the back of 216 photoreceptors, removing any residual adhesive from the back of 216 photoreceptors, and individually handling 216 photoreceptors mounted in separate bases during testing may all be eliminated with the electrophotographic imaging member and process of this invention.

Any suitable photoconductive insulating layer may be applied to the aluminum oxide layer. A selenium-arsenic chlorine doped alloy is preferred for optimum performance in xeroradiographic dental plates. The selenium-arsenic alloy preferably comprises between about 0.05 percent by weight and about 2 percent by weight arsenic and a halogen selected from the group consisting of up to about 100 parts per million by weight of chlorine with the remainder being selenium. The expression "selenium-arsenic alloy" is intended to include halogen doped alloys as well as alloys not doped with halogen. Optimum x-ray sensitivity, x-ray absorption and maximum bi-polar carrier transport efficiency, are achieved with selenium-arsenic alloy layers containing between about 0.2 percent and about 0.5 percent by weight arsenic and between about 5 parts per million and about 25 parts per million by weight chlorine with the remainder being selenium. The preferred halogen is chlorine. Concentrations of arsenic exceeding about 2 percent by weight lead to excessive hole trapping and concentrations of arsenic less than about 0.05 percent by weight results in a marked tendency to crystallize. As the chlorine content rises above about 25 parts per million by weight chlorine, the photoreceptor begins to exhibit excessive electron trapping. The selenium-arsenic alloy x-ray photoconductive layer can be prepared in one preferred embodiment by thermally blending selenium-arsenic alloy shot, with or without halogen doping and preparing water quenched shot having an average diameter, for example, of about 6 millimeters from the thermally blended high purity selenium, high arsenic selenium and chlorine doped selenium.

The selenium-arsenic alloy may be at least partially crystallized by placing the selenium alloy in shot form in a crucible in a vacuum coater and heated to between about 121° C. (250° F.) and about 177° C. (350° F.) for between about 15 minutes and about 2 hours to increase crystallinity to avoid reticulation. Preferably, the selenium-arsenic alloy material in shot form is heated until from about 2 percent to about 90 percent by weight of the selenium in the alloy is crystallized. The selenium-arsenic alloy material shot may be crystallized completely prior to vacuum deposition to ensure that a uniform starting point is employed. However, If desired, a completely amorphous alloy may used as the starting material for vacuum deposition.

Any suitable conventional vacuum coating apparatus may be employed to vacuum deposit a selenium or selenium x-ray photoconductive insulating layer onto the substrate while the substrate is mounted on a magnetic support member. The selenium or selenium alloy shot in crucibles in a vacuum coater are evaporated using a time/temperature schedule. The schedule is designed to minimize fractionation during evaporation if an alloy is used. For selenium-arsenic alloys, the percentage of arsenic in the starting selenium alloy shot is substantially the same as the percentage of arsenic in the deposited alloy layer. Maintaining the arsenic concentration between about 0.3 percent and about 2 percent by weight and the chlorine concentration below about 30 parts per million throughout the selenium alloy thickness facilitates both hole and electron transport. In a typical crucible evaporation program, the alloy layer is formed in about 35 to about 45 minutes during which time the crucible temperature is increased from about 221° C. (430° F.) to about 287° C. (550° F.) and the substrate is maintained at a temperature of between about 71° C. (160° F.) and about 80° C. (176° F.). Chamber pressure during evaporation is on the order of less than about $8\times10^{-5}$ Torr. The amount of alloy present in the crucibles will depend upon the specific coater configuration and other process variables but will be calibrated to yield the desired thickness. Satisfactory results may be achieved with a selenium-arsenic alloy photoconductive alloy layer having between about 0.3 percent and about 2 percent by weight arsenic at the surface of the photoconductive insulating layer facing away from the conductive substrate and a thickness between about 100 micrometers and about 400 micrometers. Levels of arsenic exceeding about 2 percent can lead to reticulation, a catastrophic wrinkling of the surface of the photoconductive insulating layer facing away from the conductive substrate. Such wrinkling can render the imaging member unsuitable for applications which require highly detailed and precise images such as dental images and mammagrams. A selenium-arsenic alloy layer having a thickness greater than about 400 micrometers generally results in low contrast and high defect levels. Thicknesses less than about 100 micrometers tend to exhibit photon shot noise from limited x-ray absorption. Optimum results are achieved with alloy layers having a thickness between about 100 micrometers and about 180 micrometers for dental xeroradiographic plates.

Preferably, the selenium-arsenic alloy layer is deposited to the very edge of the substrate to facilitate dental imaging. Edge deposition is achieved by virtue of the magnetic substrate mounting directly to the planet without the use of cumbersome and costly masks.

Any suitable continuous overcoating may be employed. The overcoating should have a thickness of between about 0.05 micrometer to about 0.3 micrometer. A thin protective overcoating layer having a thickness between about 0.05 micrometer and about 0.3 micrometer is preferred because excessive overcoating thickness degrades image resolution. Any suitable film forming resin may be employed in the overcoating. Typical film forming resins include polyester, polyurethane, polyvinylidene chloride, polysiloxanes, polymethyl methacrylate containing trimethyl ammonium chloride, and the like and mixtures thereof. Additives may also be added to the overcoating. These additives may be incorporated into the overcoating to render it slightly more electrically conductive, e.g. about $10^{12}$ to about $10^{14}$ ohm cm. Preferably, the overcoating contains from about 0.3 percent to about 0.9 percent by weight nigrosine, based on the total weight of the overcoating to provide transverse electrical conductivity of the overcoating and to eliminate fatigue. Optimum results are obtained with an overcoating comprising a mixture of about 0.5 percent to about 0.7 percent by weight nigrosine, about 45 percent to about 55 percent by weight polyester resin, about 25 percent to about 35 percent by weight polyvinylidene chloride, and about 10 percent to about 20 percent by weight polyurethane, based on the total weight of the overcoating. The overcoating may be applied to the photoconductive insulating layer by any suitable technique while the electrophotographic imaging member remains mounted on a magnetic support member. Typical coating techniques include spraying, roll coating, brushing, spin coating, flow coating, and the like.

The photoreceptor may be magnetically mounted for testing so that the costly lamination step may be delayed until after acceptable plates are identified. The photoreceptor is charged and developed using liquid development. This test determines the photoreceptor defect level, the primary reason for rejection. Other tests include measurement of the initial photoreceptor potential and the dark decay rate using a self nulling vibrating reed Monroe electrometer.

The electrophotographic imaging member of this invention may be employed in conventional cyclic xeroradiographic imaging processes involving repeated uniform charging, imagewise exposure, development, transfer, erase and cleaning cycles. Any suitable development technique may be utilized to develop the electrostatic latent image on the electrophotographic imaging member of this invention. Typical well known electrophotographic development techniques include, for example, cascade development, magnetic brush development, liquid development, powder cloud development and the like. The deposited toner image may be transferred to a receiving member by any suitable conventional transfer technique including tape transfer and affixed to the receiving member by any suitable well known fixing technique. Cleaning of the photoreceptor to remove any residual toner particles remaining after transfer may be effected by any suitable conventional cleaning technique such as brush cleaning, blade cleaning, web cleaning, foam roll cleaning and the like. Erasure of the electrostatic latent image may also be accomplished by any suitable conventional technique. Typical conventional erase techniques include AC corona discharge, negative corona discharge, illumination from a light source, contact with a grounded conductive brush, and combinations thereof.

The magnetically attractible, electrophotographic selenium-arsenic alloy photoreceptors of this invention are x-ray sensitive and are particularly suitable for dental imaging systems. The process of this invention more efficiently and rapidly provides an x-ray sensitive photoreceptor having an exceptional gray scale in fewer process steps with less waste. Thus, the planar substrates may remain mounted to the original magnetic support member or transferred to other magnetic support members. During deposition of the photoconductive insulating layer, during application of the protective overcoating, during drying or curing of the protective overcoating and during testing. Fingerprints or scratches on the substrate, photoconductive insulating layer or overcoating layer are avoided. Moreover, the prior art steps of manually applying 216 pieces of double sided adhesive tape to the back of 216 photoreceptors, out gassing undesirable gasses and vapor contained in the adhesive tape, removing the 216 pieces of double sided adhesive tape from the back of 216 photoreceptors, removing any residual adhesive from the back of 216 photoreceptors, and individually handling 216 photoreceptors mounted in separate bases during testing are all eliminated with the electrophotographic imaging member and process of this invention. The plates of this invention can also be loaded and unloaded more rapidly from coating equipment.

A number of examples are set forth herein below that are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I 216 pieces of double sided adhesive tape was manually applied to 216 aluminum substrate plates having a width of about 4 centimeters, a length of about 3 centimeters and a thickness of about 0.05 centimeter. Each of these taped plates were thereafter pressed against a planet support member using great care to avoid depositing fingerprints on the exposed substrate surface. The support member bearing the plates was inserted into a vacuum chamber for deposition of selenium onto the substrate. Prior to deposition of the selenium onto the substrate plates, a vacuum was imposed on the vacuum chamber to outgas undesirable gasses and vapor contained in the adhesive tapes. After vacuum deposition of a selenium photoconductive insulating coating on the plates, the 216 plates are thereafter removed from the vacuum coater and coated with protective overcoating material. The tape was thereafter removed from each of the 216 plates and the plates cleaned by manual sanding and solvent application to remove any residual adhesive. Great care was again taken to avoid depositing fingerprints on the surface of the overcoating. Each of the 216 plates were then individually glued to separate plastic bases and individually tested for defects. Considerable care was also necessary during testing to avoid depositing fingerprints on the surface of the overcoating. Defects found in the plates required discarding of the plate and the attached plastic base. The plates passing the test were utilized in light tight packages for insertion into a patient's mouth during x-ray exposure. Thus, this process was tedious, time consuming and traumatic from the viewpoint of the photoreceptor.

EXAMPLE II 216 new substrate plates may be prepared consisting of a flat nickel layer having a thickness of 0.4 mm clad with an adjacent aluminum coating having a thickness of about 0.1 mm, and an outer aluminum oxide surface layer of about 200 Angstroms. These substrate plates may have a length of about 3 cm and a width of 4 cm. These photoreceptors may simply be placed on strip magnetics supported on a support frame adapted to roll into a horizontal tube shaped vacuum chamber. Since no adhesive tape is necessary to secure each photoreceptor to the support frame, an outgassing step is unnecessary. After vacuum deposition of a selenium coating onto the aluminum oxide coating, the resulting photoreceptors may be coated with an overcoating while the plates remain magnetically secured to the support frame inside or outside the vacuum coater. Each of the photoreceptors may then be tested for photoconductive properties with or without removing the photoreceptors from the support frame. No application and removal of double-sided tape will be necessary. Moreover, the substrate will not have to be cleaned because there will be no residual adhesive on the substrate plates. Further, it will be unnecessary to glue the photoreceptors onto plastic bases for testing. Any defective photoreceptors discovered during testing could be discarded without loss of the plastic base. Further, time that was previously required to glue a photoreceptor to the plastic base will not be lost for discarded photoreceptors. Thus, many processing steps can be eliminated and fabrication and coating time can be markedly reduced.

Although the invention has been described with reference to specific preferred embodiments, it is not intended to be limited thereto, rather those skilled in the art will recognize that variations and modifications made be made therein which are within the scope of the invention and within the scope of the claims.

What is claimed is:

1. A planar electrophotographic imaging member comprising a magnetically attractable, electrically conductive layer, a thin aluminum layer having a thickness up to about 1000 micrometers, an aluminum oxide blocking layer and at least one photoconductive insulating layer overlying said aluminum oxide blocking layer and a protective overcoating.

2. An electrophotographic imaging member according to claim 1 wherein said magnetically attractable, electrically conductive layer comprises nickel having a planar shape contiguous with said aluminum layer.

3. An electrophotographic imaging member according to claim 2 wherein said photoconductive insulating layer comprises a selenium alloy having a thickness between about 100 micrometers and about 400 micrometers.

4. An electrophotographic imaging member according to claim 3 wherein said selenium alloy comprises between about 0.05 percent and about 2 percent by weight arsenic at the surface of said photoconductive insulating layer facing away from said aluminum oxide blocking layer.

5. An electrophotographic imaging member according to claim 3 wherein said selenium alloy is doped with a halogen.

6. An electrophotographic imaging member according to claim 3 wherein said alloy layer is coated with a thin protective overcoating layer comprising a film forming binder, said overcoating layer having a thickness between about 0.05 micrometer and about 0.3 micrometer.

7. A process for preparing an electrophotographic imaging member comprising providing a planar substrate comprising a magnetically attractable, electrically conductive layer and a thin blocking layer, mounting said planar substrate on a magnetic support member, said blocking layer facing away from said magnetic support member, and applying at least one photoconductive insulating layer to said blocking layer to form a photoconductive insulating layer overlying said blocking layer while said planar substrate remain mounted on said magnetic support member.

8. A process for preparing an electrophotographic imaging member according to claim 7 including applying an overcoating to said photoconductive insulating layer while said imaging member is mounted on a magnetic support member.

9. A process for preparing an electrophotographic imaging member according to claim 8 including electrically testing said electrophotographic imaging member while said imaging member remains mounted on a magnetic support member.

10. A process for preparing an electrophotographic imaging member according to claim 7 wherein said photoconductive insulating layer is an alloy of selenium and arsenic having a thickness between about 100 micrometers and about 400 micrometers.

11. A process for preparing an electrophotographic imaging member comprising providing a planar substrate comprising a magnetically attractable, electrically conductive layer, a thin aluminum layer having a thickness up to about 1,000 micrometers and an aluminum oxide blocking layer having a thickness of between about 50 and about 500 angstroms, mounting said planar substrate on a magnetic support member, said blocking layer facing away from said magnetic support member, and applying at least one photoconductive insulating layer to said blocking layer to form a photoconductive insulating layer having a thickness between about 100 micrometers and about 400 micrometers overlying said blocking layer while said planar substrate remains mounted on said magnetic support member and applying an overcoating to said photoconductive insulating layer while said planar substrate remains mounted on said magnetic support member.

* * * * *